United States Patent [19]

Sartain

[11] 4,240,225

[45] Dec. 23, 1980

[54] CORNER GUARD

[76] Inventor: Don M. Sartain, P.O. Box 314, Wabasso, Fla. 32970

[21] Appl. No.: 57,567

[22] Filed: Jul. 16, 1979

[51] Int. Cl.[3] ..... E05F 7/00

[52] U.S. Cl. ..... 49/462; 248/345.1

[58] Field of Search ..... 49/460, 70, 50, 462; 248/345.1; 52/716, 657

[56] References Cited

U.S. PATENT DOCUMENTS

| | | | |
|---|---|---|---|
| 2,139,312 | 12/1938 | Mullens | 49/462 |
| 3,358,725 | 12/1967 | Bussard et al. | 248/345.1 X |
| 3,566,538 | 3/1971 | McCallum | 49/460 X |
| 3,725,188 | 4/1973 | Kalt | 248/345.1 X |

*Primary Examiner*—Kenneth Downey
*Attorney, Agent, or Firm*—Paul H. Gallagher

[57] ABSTRACT

An integral piece for applying to a sharp corner element such as on a window frame, having a base with a recess in its under surface with flanges or ribs on two contiguous sides. Rising from the base is a rounded boss, symmetrical on a diagonal line from the juncture of the flanges. When applied to the window frame, the flanges fit against the edges of the frame forming the sharp corner, and the boss extends both up from the base and generally toward the corner. The symmetry of the guard enables it to fit either corner of the window frame, i.e., either right or left. The guard is held in place alternatively by an adhesive material, or mechanical means such as a screw.

3 Claims, 5 Drawing Figures

FIG. 1.
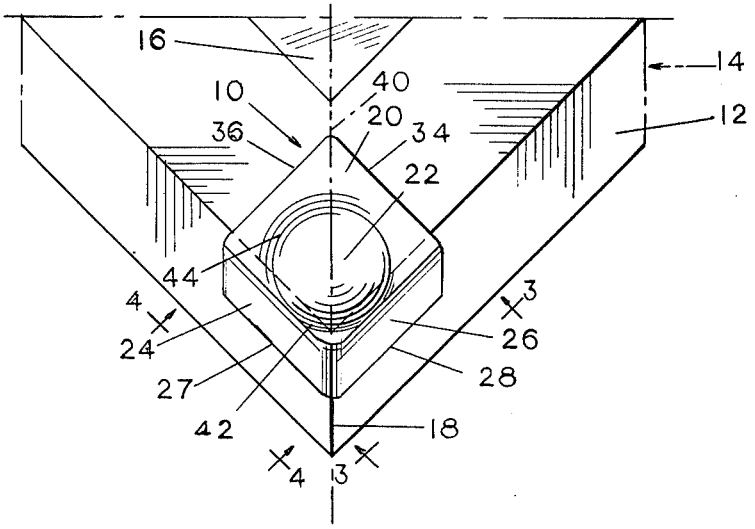
FIG. 4.
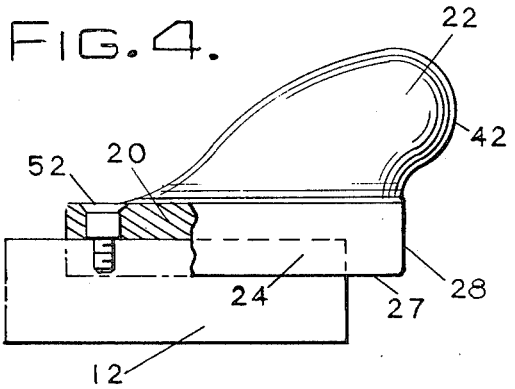
FIG. 3.
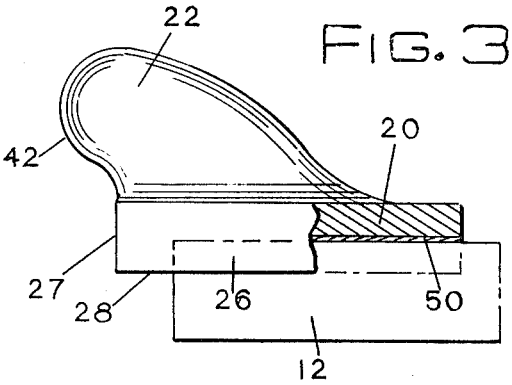
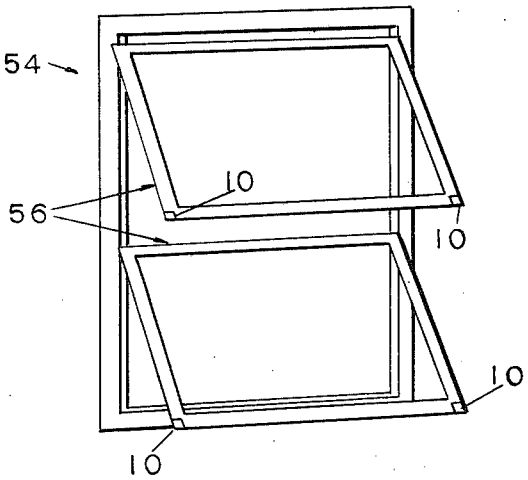
FIG. 5.
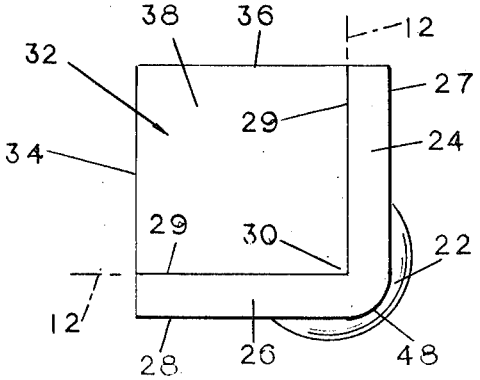
FIG. 2.

CORNER GUARD

OBJECTS OF THE INVENTION

A broad object of the invention is to provide a novel guard for a sharp corner such as of a window frame, to prevent accidental injurious contact with the corner, having particularly the following advantages;

(a) It is extremely simple and correspondingly easy to apply to the corner to be guarded.

(b) Its simplicity results in corresponding economy in manufacture.

(c) It is unusually effective in protecting a person from contacting the sharp corner.

(d) It is symmetrical whereby to equally well fit either a right hand or a left hand corner.

(e) It is of such unusual design as to resist displacement if contacted in direction against either of the edges forming the corner.

DESCRIPTION OF A PREFERRED EMBODIMENT

In the drawing:

FIG. 1 is a perspective view of the window guard of the invention applied to a window frame, and showing a portion of the window frame;

FIG. 2 is a large scale bottom view of the corner guard;

FIG. 3 is a large scale side view taken at line 3—3 of FIG. 1 partially broken away;

FIG. 4 is a large scale side view taken at line 4—4 of FIG. 1 partially broken away; and FIG. 5 is a perspective view of a window having a plurality of sashes, and corner guards of the present invention applied to each of the sashes.

FIG. 1 shows the guard indicated generally at 10, applied to a frame 12 of a window sash indicated generally at 14 and having a pane 16. The window frame 12 has a sharp corner 18 which is to be protected by the corner guard 10 of the invention. The window frame 12 is representative of various devices having sharp corners to which the guard of the invention is applicable, such as metal drawers and many other such devices. The sharp corner most often occurs when the frame is made of metal.

The corner guard 10 is an integral piece preferably of a relatively pliable or soft material, such as rubber or rubber-like material, or plastic material, etc. However, the invention is of such scope that it will cover other materials as well, such for example as wood, and although wood is not generally considered soft, it does have a certain degree of resilience, particularly the softer woods.

In the case of making the corner guard of rubber-like material or plastic material, it may be molded, while if made of other materials it may be cut.

The corner guard 10 includes a base 20 and a boss 22 extending upwardly therefrom. The base is generally flat, having downwardly extending flanges 24, 26 on the underside on two contiguous sides 27, 28, respectively. The inner surfaces of the flanges are straight as indicated at 29 to fit the corresponding straight surfaces of the article to be guarded, and these surfaces of the flanges at their juncture form a sharp inside corner 30. These flanges or ribs 24, 26 form a recess 32 which opens laterally through the other sides of the guard, namely 34, 36. The recess 32 has a flat or planar floor or main surface 38.

The corner guard is applied to the member to be guarded, or window frame 12, by fitting it thereon with the corner of the frame received in the recess 32 and the extreme corner juncture of the frame fitted against the inside corner 30 of the guard, and also with the flanges 24, 26 fitted against the straight side edges of the window frame.

The corner guard is symmetrical about a diagonal axis 40 extending through the corner 30 of the guard. The boss 22 is also symmetrical about that axis 40 but is eccentric to the center of the base of the guard, extending outwardly along that axis beyond the corner. It also extends beyond the two side edges of the guard. The exact shape and dimensions of the various elements of the guard are not critical, but for the sake of convenience, an example of dimensions of a representative guard are as follows, it being understood of course that various other dimensions and proportions may be utilized: base—$1\frac{1}{8}$ inch on edge; flanges—$\frac{1}{4}$ inch deep from the top surface 38 of the base to the bottom of the flanges; flanges—3/16 inch thick; flanges—3/32 inch deep, i.e., below the surface 38 of the recess; height of guard including boss and full depth of flanges—$\frac{7}{8}$ inch; boss extends laterally beyond the side edges of the window frame, i.e., beyond the inner surfaces 29 of the flanges—$\frac{3}{8}$ inch. The boss 22 is generally rounded, having a rounded apex 42, and as viewed vertically, is generally circular at its juncture with the base, as indicated at 44. The boss merges into the base in a curvature at 44. The apex 42 of the boss extends forwardly as shown in FIGS. 3 and 4 corresponding to the extension laterally beyond the side edges, but the extension over the corner is less than over the side edges due to the curvature of the boss, these relationships being shown in FIGS. 1 and 2. The base of the guard is also rounded at its front corner as indicated at 48, FIG. 2. The boss rises relatively abruptly at the sides, as viewed in FIG. 1, and at a flatter slope in the rear,—the right in FIG. 3, and the left in FIG. 4.

The guard may be secured to the window frame by an adhesive material indicated at 50 in FIG. 3, utilizing any presently known adhesive material suitable for the purpose. This adhesive material is preferably spread over the entire surface 38 of the recess and the inner side surfaces 29 of the flanges, to make maximum adhering contact. The utilization of an adhesive material is a great advantage both in the small expense involved for the material, and the convenience with which the guard is applied to the member. This form of securement may be utilized in the home for example, where the simplest form of securement is desired.

The guard may be alternatively be applied to the window frame 12 or window to be guarded, by a mechanical securing means such as a screw 52 as shown in FIG. 4 which is merely threaded through an aperture in the base 20 of the guard and into the frame. This screw means is of course more permanent and can be readily utilized particularly in the case of industrial or commercial applications.

The corner guard is preferably colored brightly, such as red, to render it readily visible. The coloring may be the use of paint applied thereto, or of course if desired the material from which the device is made may be colored throughout.

FIG. 5 shows a window 54 having a plurality of sashes 56. The corner guards 10 are applied to the corners of these sashes and it will be noted that both of laterally opposite corners are fitted with the guards. The symmetry of the guards about the axis 40 assures that they fit equally well on both the right and left hand corners of the sashes, so that any single guard will fit on any corner. The recess 32 being open on two sides also accommodates this application to the opposite corners.

The corner guard thus protects a person against accidental injurious contact with a sharp corner, from either of the side edges, or from the corner itself, along the axis line 40, or from above, directly down against the boss. Thus the corner guard is extremely effective, it is inexpensive both in material used, method of manufacture, and applying it to the frame to be guarded. It protects a person from injurious contact from substantially all directions.

I claim:

1. A corner guard for use on a window in a wall, in combination with that window, wherein, the window includes at least one sash having a surrounding frame, the sash is swingable between open and closed positions on an axis adjacent the wall the having a swingable edge spaced from the wall when in open position, and the sash when in closed position lies closely adjacent the plane of the wall with the swinging edge consequently also closely adjacent that plane, the sash having an inner surface and an outer surface relative to its closed position, the frame being of metal or similar hard material having sharp corners which readily cause injury to the body of a person having impact therewith, the corner guard being an integral article including a base and a boss rising therefrom, the base having a recess in an under side defined on one side by a main surface of the base, and on other sides by downwardly extending flanges on two contiguous sides of the base, the surfaces of the base that define the recess being flat and commonly intersecting and defining a sharp inside corner, the corner guard being fitted to the outer surface of frame with the main surface of the recess engaging the outer surface of the frame, and the flanges engaging the peripheral edges of the frame, the inner surface of the frame being clear of the corner guard and correspondingly unobstructed, whereby the sash can be moved to its closed position unimpeded by the corner guard and thereby capable of engaging any element in the window by the inner surface of the sash that it could engage without the corner guard fitted thereto, said boss extending laterally from the base beyond both of the flanges and the corner therebetween, and the boss and those portions of the flanges at the juncture thereof together extending the full dimension of the guard in direction perpendicular to said main surface, whereby the guard at said juncture is positioned for receiving impact from all directions except in direction against the inner surface, the material of the corner guard being softer than the metal of the frame.

2. A combination according to claim 1 wherein, the flanges are in the neighborhood of 3/32 inch deep from said main surface of the recess in direction perpendicular therefrom.

3. A combination according to claim 2 wherein, the flanges are no greater than $\frac{1}{8}$ inch in the direction stated.

* * * * *